United States Patent [19]

Siewert et al.

[11] Patent Number: 4,466,940

[45] Date of Patent: Aug. 21, 1984

[54] MULTICOMPONENT ALLOY FOR SPUTTERING TARGETS

[75] Inventors: G. A. Horst Siewert, Freigericht; Horst Dietrich, Biebergemund; Wolf-Dieter Munz, Freigericht; Jorg Goebel, Alzenau-Michelbach, all of Fed. Rep. of Germany

[73] Assignees: Demetron Gesellschaftfür Electronik-Werstoffe mbh, Hanau; Leybold-Heraeus GmbH, Cologne, both of Fed. Rep. of Germany

[21] Appl. No.: 406,612

[22] Filed: Aug. 9, 1982

[30] Foreign Application Priority Data

Oct. 27, 1981 [DE] Fed. Rep. of Germany ..... 3142541

[51] Int. Cl.[3] ..... B32B 15/04

[52] U.S. Cl. ..... 420/507; 420/469; 420/580

[58] Field of Search ..... 420/507, 469, 580

[56] References Cited

U.S. PATENT DOCUMENTS

| | | | |
|---|---|---|---|
| 1,557,431 | 10/1925 | Davignon | 420/507 |
| 2,015,499 | 9/1935 | Smith | 420/507 |
| 2,243,177 | 5/1941 | Weiss | 420/507 |
| 2,278,812 | 4/1942 | Weiss | 420/507 |
| 3,769,006 | 10/1973 | Ingersoll | 420/507 |
| 4,066,819 | 1/1978 | Anderson | 420/507 |

*Primary Examiner*—Peter D. Rosenberg
*Attorney, Agent, or Firm*—Felfe & Lynch

[57] ABSTRACT

A multicomponent alloy for targets employed in the sputter coating of gold layers, said alloy having 35% to 55%, preferably either 50% or 42%, non-aurous alloy components.

7 Claims, No Drawings

MULTICOMPONENT ALLOY FOR SPUTTERING TARGETS

The invention relates to a multicomponent alloy for targets employed in the sputtering of layers of gold with 35% to 55% and preferably either 50% or 42% nonaurous alloy components on substrates.

Objects that can be externally provided with goldenness by sputtering etc. are known from German Offenlegungsschrift No. 2 825 513. That document specifies multicomponent alloys with individual components that are positioned next to each other at random as well as being unquantified and that can be used for that purpose. To the extent that specific multicomponent alloys, like the three-part Au-Ni-Cu for example, are named in the examples of embodiments, they are named in the context of other coating processes, specifically electrochemical plating, that involve techniques that can not be transferred to sputtering. Furthermore, no quantitative details are mentioned.

Sputtering tests of the alloy components disclosed in Offenlegungsschrift No. 2 825 513 have demonstrated that such alloys can not be employed for coatings of gold or containing gold that must satisfy particular demands as to the color of the gold. Tests conducted with a three-component alloy consisting of 50% Au, 30% Cu, and 20% Ag and with a four-component alloy of 50% Au, 35% Cu, 11% Ag, and 4% Zn, for example, were not successful in sputtering on coatings with the desired characteristics.

One purpose of the present invention is to produce coatings of gold with a goldenness that has the properties, expressed in non-dimensional CIE ("International Commission on Illumination") units, $$L^* = 60\text{–}95$$

$$a^* = 1\text{–}7$$

$$b^* = 9\text{–}38,$$

where L* is lightness, a* the proportion of red, and b* the proportion of yellow in the reflected test light.

Other purposes of the invention are to increase the coating's resistance to corrosion and abrasion and to develop coating compositions that will be reproducible over a wide range of working cycles and that can be applied in succession with a single target.

The CIE units mentioned above are determined by a testing method that has been employed increasingly in recent years by the manufacturers of coatings, especially decorative coatings. This method is colorimetric. A test beam from a standard light source and with very definite spectral properties is focused on the sample and the visible range of the reflected portion analyzed. Arithmetical processing reveals not only lightness but also the proportions of red and yellow that are fundamental in determining goldenness.

The methodology is described for example by R. M. German, M. M. Guzowsky, and D. C. Wright in *Journal of Metals,* March, 1980, pp. 20 ff. and by the same authors in *Gold Bulletin,* July 1980, pp. 113 ff. Several manufacturers of commercially available color-measurement apparatus are named in Chapter 7 of the *Handbook of Optics,* by Walter G. Driscol and W. Vaughan, MacGraw Hill, 1978. Apparatus that provide results in CIE units are distributed by the firms MacBeth, Newburgh, NY, USA
Hunterlab, Reston, VA, USA
Instr. Colour Syst., Newbury, Berkshire, GB, and (Match Scan DTM 1045) Diano Corp., USA.

The purpose of the invention is achieved in accordance with the multicomponent alloy claimed in the body of claim 1, which has the composition 45% to 65% Au,
1% to 10% Al,
and
remainder Cu, with all percentages by weight.

If coatings with a 12-karat gold component are to be produced by this method, the percentage of gold will range for reasons of tolerance from 49% to 51%. If 14-karat gold is employed the percentage will range from 57.5% to 59.5%.

It must be kept in mind that different countries have different regulations as to which coatings can be designated "real" gold and which not.

Surprisingly, it turns out that the stated range results in coatings with colorations that correspond to the CIE L*, a*, and b* units stated in conjunction with the purpose of the invention. The percentage of aluminum is especially important in determining color. It has been demonstrated that, as the percentage of aluminum decreases and the copper percentage accordingly increases, the percentage a* of red reflected will increase.

It is of course known that the percentage of both red and yellow in solid or electroplated jewelry alloys can be altered by varying the percentage of silver. This known procedure has however turned out to be impossible in connection with the purpose stated above, in the context of sputtering, because the resulting goldenness was not reproducible or homogeneous. Alloys with extremely low and with relatively high silver contents were tested, with no practicable results. Nor was the reproducibility of the coating reliable over a large number of working cycles that were carried out in conjunction with a single target.

It has nevertheless been discovered, surprisingly, that the percentage of aluminum in accordance with the invention not only solves the problem of the desired goldenness but also results in satisfactory corrosion and abrasion resistances. Furthermore, a single target can be employed to apply several layers in a sequence of working cycles without impairing the reproducibility of the composition of the coating in any way.

These results are also significant because, although the coatings of an Au-Cu-Ag or Au-Cu-Ag-Zn alloy sputtered on substrates like watchcases, watchbands, and other useful objects often differ in both composition and optical properties from the targets, the alloys in accordance with the invention will make for uniformity.

Conditions can be improved even more by adding the other components claimed in claims 4 through 10 to the three-component alloys claimed in 1 through 3. Adding other components will of course reduce the percentage of copper even more. None of these figures are to be understood as in any way defining upper or lower limits for the ranges discussed. Appropriate levels will be selected experimentally, with the percentage of the additional components beyond the fourth never exceeding 15%.

It has been found for example that 0.1% to 7% and preferably 2% to 5% nickel markedly improves thermal stability in air at temperatures above 50° C. Thermal stability is significant because the coated substrate is usually removed from the sputtering layout while it is still quite a bit hotter than room temperature.

No discoloration of more than two a* and b* units is permissible at any time. Thermal stability is determined with a step-stress test, in which the temperature is raised in increments until the color or chemical composition of the surface of the coating is observed to change.

Gallium and cadmium in the alloys will improve their resistance to corrosion.

Sputtering devices or cathode systems and the plating processes employing them are state of the art. Cathode systems that lead to especially satisfactory results with the target alloy in accordance with the present invention are specified in German Offenlegungsschriften No. 3 047 113 and 3 107 914, held by one of the present applicants. The target plates disclosed in these documents are the ones for which the alloy in accordance with the present invention was first proposed.

Such a cathode system was used in carrying out the examples that will now be specified. The cathodes were mounted in a vacuum compartment that was evacuated to between $5\times10^{-6}$ and $1\times10^{-4}$ mbar before the samples were plated. Sputtering was conducted in a neutral atmosphere continuously supplied with argon as a sputtering gas at a pressure of from $1\times10^{-3}$ to $2\times10^{-2}$ bars. The parameters of current, voltage, and substrate temperature were optimized or controlled by the usual methods.

Satisfactory bonding of the coating to the substrate usually required the application of an intermediate layer as an enhancer. Brass, special steel, and nickel-silver substrates were plated with gold alloy using chrome, titanium, NiCr, molybdanum, and tungsten as adhesion enhancers. All of these enhancers seemed to be about equally effective.

EXAMPLE 1

A plate-shaped target composed of
50% Au
5% Al
and
45% Cu
was used to plate a smooth special steel substrate.
The coating exhibited the CIE properties.
L*=84
a*=2.0
and
b*=18.
The layer was very resistant to corrosion and abrasion. The same target was used 40 times without the composition of the coating deviating from normal tolerances. The composition of the coating on the substrate was demonstrated to be homogeneous no matter what the thickness of the layer or the degree of target attrition (no dissociation or color deviation).

EXAMPLE 2

The target was a plate made from an alloy with the composition
50% Au
2.5% Al
2.5% Ni
and
45% Cu.
The CIE results were
L*=83
a*=5
and
b*=13.
Resistance to corrosion and abrasion and layer-composition reproducibility were always outstanding. Reproducibility was complete even after the same target had been bombarded 15 times. Thermal stability was also excellent. The substrates plated (watchbands) were brought to a maximal temperature of 150° C. in the step-stress test with no alterations of more than 2 CIE units observed.

EXAMPLE 3
(Comparison)

The target plate was composed of
50% Au
15% Al
and
35% Cu.
The coatings, which were deposited on watchcases, exhibited the CIE values
L*=77
a*=2
and
b*=7.
Thus the excessively high percentage of aluminum resulted in too little yellow.

EXAMPLE 4

A target was composed of
58.5% Au
4% Al
35% Cu
and
2.5% Ga.
The watchbands that were plated exhibited
L*=81
a*=2
and
b*=25.
Thus, these coatings completely exemplified the required specifications for goldenness. They were also resistant to corrosion and abrasion. Even after 20 layers no alteration in the reproducibility of the coating composition was observed.

EXAMPLE 5
(Comparison)

The target plate was composed of
58% Au
4% Al
9% Ni
and
29% Cu.
The plated watchbands exhibited
L*=78
a*=0.5
and
b*=4.
These values show that the coatings did not conform to the required specifications for goldenness.

We claim:

1. Multicomponent alloy target for sputtering a layer of gold with from 35% to 55% non-aurous alloy components onto a substrate, the multicomponent alloy consisting of:
from 45% to 65% Au,
from 1% to 10% Al, from 0.1% to 7% each of one or more elements selected from the group consisting of Ga, In, Cd, Sn, Co, and Fe, and the remainder Cu, with all percentages by weight.

2. The multicomponent alloy of claim 1, wherein the consistence of Au is from 49% to 51% and of Al is from 1% to 7%.

3. The multicomponent alloy of claim 2, wherein the consistence of Au is from 57.5% to 59.5%.

4. The new use of a multicomponent alloy, comprising:

providing the multicomponent alloy comprising, by weight, from 45% to 65% of Au, from 1% to 10% of Al, and the remaining percentage of Cu as a sputtering target.

5. The new use of a multicomponent alloy, comprising:

providing the multicomponent alloy comprising, by weight, from 45% to 65% of Au, from 1% to 10% of Al, and the remaining percentage of Cu as a target; and sputtering the target onto a substrate.

6. The new use of claim 4, and additionally comprising, before determining the remaining percentage of Cu, providing to the multicomponent alloy from 0.1% to 7% each of one or more elements selected from the group consisting of Ni, Ga, In, Cd, Sn, Co, and Fe.

7. The new use of claim 5, and additionally comprising, before determining the remaining percentage of Cu, providing to the multicomponent alloy from 0.1% to 7% each of one or more elements selected from the group consisting of Ni, Ga, In, Cd, Sn, Co, and Fe.

* * * * *